United States Patent [19]

Maslakov et al.

[11] 4,303,002

[45] Dec. 1, 1981

[54] HAND-OPERATED PNEUMATIC IMPACT MACHINE

[76] Inventors: Petr A. Maslakov, ulitsa Nikitina, 70, kv. 131; Nikolai A. Klushin, ulitsa Krylova, 41, kv. 10; Leonid A. Juriev, ulitsa Dovatora, 25, kv. 136; Vladimir I. Kokarev, 2 Krasnogorsky pereulok, 11, all of Novosibirsk; Viktor E. Kilin, ulitsa Posadskaya, 44, korpus 2, kv. 40, Sverdlovsk; Anas G. Galimov, ulitsa Kuibysheva, 115, kv. 13, Sverdlovsk; Oleg Y. Sutyagin, ulitsa Dekabristov, 5, kv. 31, Sverdlovsk; Oleg A. Yankovsky, ulitsa S. Morozovoi, 175a, kv. 95, Sverdlovsk, all of U.S.S.R.

[21] Appl. No.: 103,513

[22] Filed: Dec. 12, 1979

Related U.S. Application Data

[63] Continuation of Ser. No. 874,238, Jan. 31, 1978.

[51] Int. Cl.[3] ..... F01L 25/04; F01L 21/02

[52] U.S. Cl. ..... 91/225; 91/317; 91/319; 91/325

[58] Field of Search ..... 91/222, 225, 317, 299, 91/325, 319

[56] References Cited

U.S. PATENT DOCUMENTS

| | | | |
|---|---|---|---|
| 2,619,038 | 11/1952 | Davidson | 91/222 |
| 3,171,809 | 3/1965 | Cox | 91/222 |
| 3,254,571 | 6/1966 | Kuhn | 91/222 |
| 3,892,280 | 7/1975 | Klushin | 173/162 |

FOREIGN PATENT DOCUMENTS

| | | |
|---|---|---|
| 967550 | 11/1957 | Fed. Rep. of Germany . |
| 1457415 | 9/1966 | France . |

*Primary Examiner*—Paul E. Maslousky

*Attorney, Agent, or Firm*—McAulay, Fields, Fisher, Goldstein & Nissen

[57] ABSTRACT

A hand-operated pneumatic impact machine comprising a hollow body with an axially-reciprocating impact ram inside which forms, together with the body, variable-volume working chambers. It also comprises a distributing space communicating with the working chambers and with a source of compressed air. There also is a valve in the form of a cylindrical bushing whose inner surface covers at least one hole which admits compressed air into the distributing space, the compressed air forcing the valve to cover alternately the inlet channels of the working chambers for reciprocating the impact ram. The valve has at least one longitudinal channel which is in constant communication with the source of compressed air through a hole which connects the distributing space with the source of compressed air, the channel being intended to deliver compressed air to the inlet channels of the working chambers.

3 Claims, 5 Drawing Figures

HAND-OPERATED PNEUMATIC IMPACT MACHINE

This is a continuation of application Ser. No. 874,238 filed Jan. 31, 1978 now abandoned.

FIELD OF THE INVENTION

The present invention relates to pneumatic impact machines and, more specifically, to hand-operated machines used in machine building, viz., in a foundry for compacting the moulding sand, as well as in construction and public utility services for compacting soil, sand, etc.

PRIOR ART

Known in the prior art is a pneumatic hand-operated impact machine (see, for example, French Pat. No. 1,457.415. Cl. B25d, France) comprising a hollow body with a distributing space and an impact ram which forms working chambers inside said body.

The distributing space has walls with the upper and lower end plates and communicates with channels for the admission and discharge of compressed air. Accommodated in the distributing space of the body with a provision for limited movement is a valve mounted in such a manner that while it moves in the distributing space of the body its external cylindrical surface slides over the corresponding surface of said space. The upper and lower surfaces of the valve are adapted for contacting the corresponding plates of the distributing space.

The valve and the walls of the distributing space form alternately channels in the form of gaps between the matching surfaces of the valve and distributing space. The size of these gaps governs the amount of compressed air entering the working chambers of the machine, and the travel of the valve.

A disadvantage of this machine lies in a highly complicated design of the air-distributing device which is attributed to the utilization of precision friction surfaces and to the necessity of maintaining accurate dimension of the channels formed by the gaps between the surfaces of the valve and distributing space, i.e. the travel of the valve.

These factors reduce the reliability of the machine due to penetration of foreign matter into the air distributing device and accumulation of carbon deposits on the valve surfaces and the distributing space.

Also known in the prior art is a pneumatic hand-operated impact machine (see German Pat. No. 967.550, Cl.876,2/05, Federal Republic of Germany) comprising a body with a distributing space which has walls with the upper and lower plates and communicates with the channels for admitting and discharging compressed air. The compressed air discharge channels open on the plates of the distributing space.

The machine also has a valve made in the form of a circular plate arranged in the distributing space with a provision for limited movement therein. The valve has upper and lower plates intended to contact the corresponding plates of the distributing space. This ensures alternate closing of the compressed air discharge channels.

The valve and the walls of the distributing space form alternately the channels made in the form of gaps between the corresponding plates. The size of the gaps forming the channels determines the amount of delivered compressed air. It is good practice to maintain the size of this gap constant in operation. This constancy of the gap is a prerequisite for steady performance of the machine. As a rule, this size does not exceed 2 mm.

On the other hand, the size of the gap governs the travel of the valve. However, it is known that in the process of operation the valve travel is liable to decrease which is caused by the accumulation of carbon deposits on the valve plates and on the distributing space. These deposits are formed due to the presence of oil in compressed air and due to operation in a dust-laden atmosphere. This carbonization reduces the size of the gap thereby reducing the amount of compressed air entering the working spaces of the machine and, as a result, decreases its power. The dependence of the valve travel on the size of the gap governing the amount of admitted compressed air denies the possibility of ensuring a larger valve travel which is one of the disadvantages of this type of air distribution.

Additionally, a small travel of the valve is difficult to obtain not only in the process of manufacture but also during routine repairs. All these factors step up the manufacturing costs, complicate the process of manufacture, and impair the operational reliability of the machine.

In order to reduce the sensitivity of the machine to the manufacturing errors and operating conditions, it is desirable to increase the valve travel.

There were attempts to proceed in this direction, one of which has materialized in the air distributing device of the hand-operated pneumatic impact machine (see U.S. Pat. No. 3,892,280, Cl, 173/162, USA) comprising a hollow body accommodating an axially reciprocating impact ram. Said ram forms variable volume working chambers in said hollow body. Additionally, the machine comprises a distributing space whose walls have upper and lower plates and which communicates with the working chambers and a source of compressed air. Located inside the distributing space is a valve also provided with upper and lower plates. To ensure the reciprocating motion of the impact ram, said valve actuated by compressed air covers alternately the inlet holes of the working chambers.

As distinct from the previously mentioned hand-operated pneumatic impact machines, this machine has a valve made in the form of a semicircular or segment-shaped plate.

As compared with the valve in the form of a full-circular plate, all other factors being equal this design of the valve reduces its air-passing capacity. This amount of air decreases as many times as the area of the described valve is smaller than the area of the valve in the form of a full-circular plate.

To put it in other words, the segment-shaped valve decreases the area through the channels formed between the corresponding plates of the valve and those of the walls of the distributing space. In order to keep the area through these channels unchanged, i.e. to maintain a constant amount of compressed air passing through the valve, it is necessary to increase the valve travel. In this case the valve travel is increased as many times as the area through the segment-shaped valve is smaller than the area of the full-circular valve.

The introduction of a segment-shaped valve simplifies the manufacturing technology of the air distributing device but fails to ensure dependable performance of the machine.

Thus, it can be seen that in the air distributing devices of the prior art hand-operated pneumatic impact machines the same surfaces are used both for adjusting the amount of passing compressed air and for controlling its distribution. This is what causes the above-mentioned disadvantages.

SUMMARY OF THE INVENTION

An object of the present invention is to provide a hand-operated pneumatic impact machine whose air distributing device ensures its operational dependability.

Another object of the invention is to provide a pneumatic machine whose air distributing device is simple to manufacture.

And still another object of the invention is to provide a pneumatic machine whose air distributing device is cheap to manufacture.

The essence of the invention consists in providing a hand-operated pneumatic impact machine whose hollow body accommodates an axially reciprocating impact ram which constitutes, together with said body, variable-volume chambers and the body has a distributing space communicating with the working chambers and with a source of compressed air, said space accommodating a valve which is actuated by air for covering alternately the inlet holes of the working chambers in order to reciprocate the impact ram wherein, according to the invention, the valve is made in the form of a cylindrical bushing whose internal surface covers at least one hole admitting compressed air into the distributing space, said hole opening into at least one longitudinal channel in the valve while said channel is in constant communication with the source of compressed air through said hole and is intended to feed compressed air to the inlet holes of the working chambers.

This permits the valve to act as a distributor of compressed air between the working chambers of the machine and as a regulator of the amount of air passing at different points between the different surfaces and independently of one another. This, in turn, makes it possible to increase the valve travel and, as a result, to render the air distributing device insensitive to the accumulation of carbon deposits on the surfaces of the valve and distributing space, thereby increasing the operational reliability of the machine.

It is expedient that the distributing space should be located in the impact ram and provided with a rod accommodating an internal channel one end of which can communicate with the distributing space and the other, with the source of compressed air, said valve being mounted on said rod, coaxially therewith.

This will simplify considerably the processability of the air distributing device and cheapen its manufacture.

It is likewise expedient that the channel delivering compressed air to the inlet holes of the working chambers should be formed by the gap between the internal surface of the valve and the external surface of the rod.

This will simplify the design of the air distributing device. In the hand-operated pneumatic impact machine realized, in accordance with the present invention, the air-distributing device ensures its reliable operation, is simple and cheap in manufacture.

BRIEF DESCRIPTION OF THE DRAWINGS

Now the invention will be described in detail by way of example with reference to the accompanying drawings, in which.

DETAILED DESCRIPTION

In describing the present embodiment of the invention the terms in their narrow sense are used for the sake of lucidity. However, the invention is not confined to the narrow sense of the terms used and it will be understood that each of said terms embraces all the equivalent terms functioning similarly and employed for the same purposes.

Figure 1:
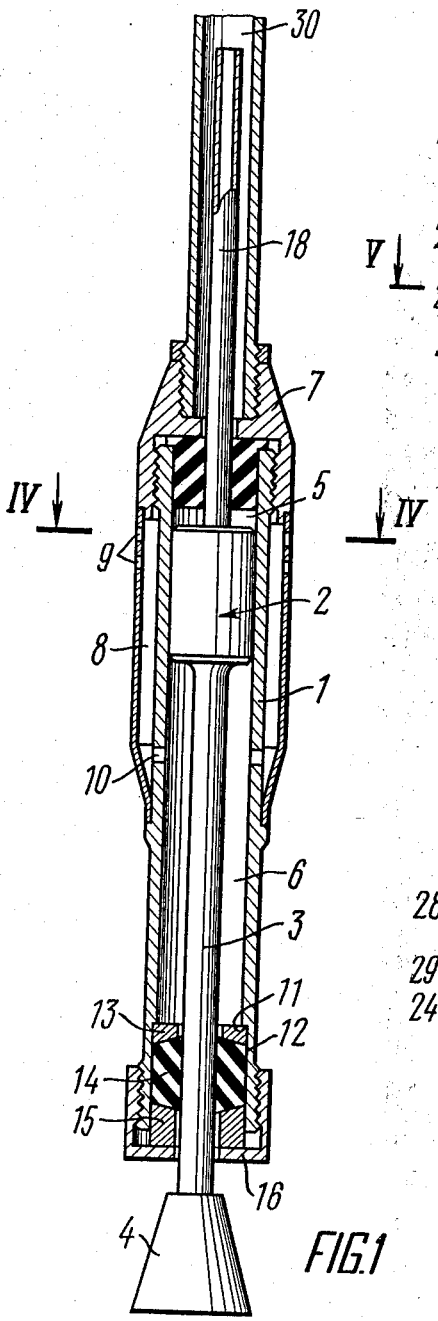
FIG. 1 is a longitudinal section through the hand-operated pneumatic impact machine according to the present invention.

The hand-operated pneumatic impact machine shown in FIG. 1 and acting as an impact ram comprises a hollow body 1 accommodating a longitudinally-reciprocating impact ram or piston 2 whose working element 3 carries a working tool (shoe) 4. The body 1 and impact ram 2 form working chambers 5 and 6. The body 1 is enclosed in a housing 7. Between the housing 7 and the body 1 there is a chamber 8. Said chamber 8 is communicated with the atmosphere through the holes 9 in the wall of the housing 7. The spent compressed air is discharged from the working chambers 5 and 6 through outlet holes 10 in the body 1, said holes or exhaust ports being in communication with the atmosphere through the chamber 8 and the holes 9.

Located inside the body 1, in its lower portion, is a recess 11 which forms a circular surface 12 of the body 1. Resting on this surface is a box 13 provided with a central hole for free passage of the working element 3. A seal 14 mounted below the box 13 prevents air leaks from the space 6 into the atmosphere through the clearances between the box 13 and the working element 3 and between the box 13 and the body 1.

The seal 14 is made of felt or like material and is pressed against the box 13 by a bushing 15 which, in turn, is pressed by a nut 16 screwed on the body 1 and having a central hole for the free passage of the working element 3. As the seal 14 is gradually worn out, the nut 16 can be screwed on the body 1 thus compressing the seal 14 and extending its service life.

Figure 2:
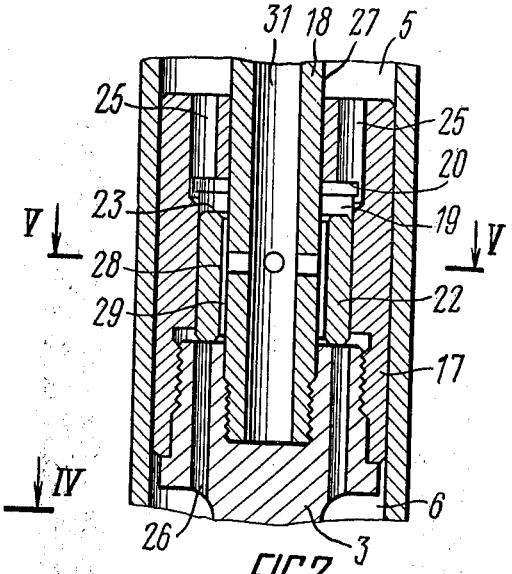
FIG. 2 is a longitudinal section through the impact ram with the valve in the lowermost position.
Figure 3:
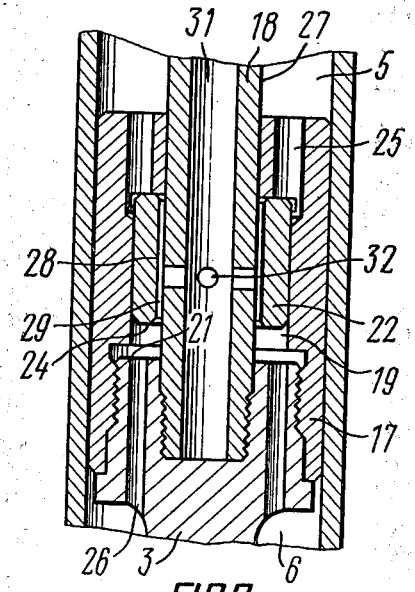
FIG. 3 is a longitudinal section of the impact ram with the valve in the uppermost position.
Figure 4:
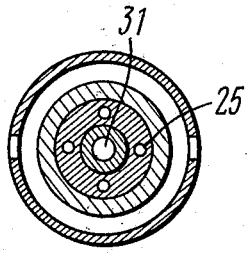
FIG. 4 is a section taken along line IV—IV in FIG. 1.

The impact ram 2 is of a built-up type. It comprises a liner 17 (FIGS. 2,3) screwed into which is the working element 3. The liner 17 is provided with a piston rod 18 which enters the impact ram or piston 2 and is secured to the working element 3 by a screw thread. The liner 17, rod 18 and working element 3 form a cavity or distributing chamber or space 19 (FIG. 2,3) having an upper surface 20 (FIG. 2) and a lower surface 21 (FIG. 3). Arranged coaxially with the rod 18 in the distributing space 19 is a valve 22. The valve 22 has an upper surface 23 (FIG. 2) and a lower surface 24 (FIG. 3), said surfaces being intended to contact the corresponding surfaces 20 and 21 (FIG. 2, 3) of the distributing space 19. The valve 22 is made in the form of a cylindrical bushing and may be made either of steel or plastic. The liner 17 has channels 25 (FIGS. 2,4) and the working element 3 has channels 26 (FIGS. 2,3) opening onto the corresponding surfaces 20 and 21 of the distributing space 19.

The channels 25 communicate with the chamber 5 and the channels 26, with the chamber 6. There is always a certain gap between the surfaces 20 and 21 of the distributing space 19 and the respective surfaces 23 and 24 of the valve 22 because the height of the valve 22 is less than that of the distributing space 19.

Figure 5:
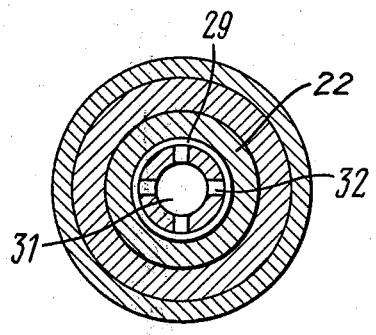
FIG. 5 is a section taken along line V—V in FIG. 2.

Thus, the valve 22 is capable of restricted movement in the distributing space 19. There is a circular channel 29 formed between the external surface 27 of the rod 18 and the internal surface 28 of the valve 22. The surface 27 of the rod 18 is a bounding surface of the distributing space 19 and serves as a connecting surface of the end surfaces 20 and 21 of the distributing space. A space 30 located in the upper portion of the housing 7 (FIG. 1) is in constant communication with a source of compressed air (not shown in the drawing) and receives the rod 18. The rod 18 (FIGS. 2,3) has a conduit or channel 31 communicating with the circular channel 29 through ports or holes 32 (FIGS. 3,5) made in the rod 18 and facing the inner surface 28 of the valve 22.

The hand-operated pneumatic impact machine shown in FIG. 1 operates as follows.

Let us assume that the initial position of the machine is that shown in FIG. 1 wherein the ram 2 is positioned so that the chamber 6 communicates with the atmosphere through the outlet holes 10, chamber 8 and holes 9. At this stage the valve 22 occupies the lowermost position (FIG. 2) and its lower surface 24 contacts the lower surface 21 of the distributing space 19 thereby covering the channels 26 in the working member 3. A clearance between the upper surface 23 of the valve 22 and the upper surface 20 of the distributing space 19 puts the channels 25 in communication with the channel 31 of the rod 18 (FIG. 2,3) through the channel 29, and holes 32.

When the hand-operated pneumatic machine is set in operation, compressed air starts flowing from the space 30 through the channel 31 and holes 32 into the distributing space 19 through the channel 29 wherein the amount of this air is controlled. From the space 19 the compressed air flows through channels 25 into the chamber 5. The chamber 6 is isolated by the valve 22 from the distributing chamber 19 and communicates through the outlet holes 10, chamber 8 and holes 9 with the atmosphere. Being acted upon by the compressed air from the chamber 5, the ram 2 starts moving down.

After the outlet holes 10 have been covered, the compressed air contained in the chamber 6 starts to be compressed so that pressure in this chamber starts building up. Likewise, the pressure applied to the lower surface 24 of the valve 22 conveyed through the channels 26 also starts to increase. Continuing in its downward stroke, the ram 2 uncovers the outlet holes 10 thus discharging air from the chamber 5. Pressure in the chamber 5 drops practically to the atmospheric level and so does the pressure in the gap between the upper surface 20 of the distributing space 19 and the upper surface 23 of the valve 22 because the area through the channels 26 is far greater than that through the channel 29. The force acting on the valve 22 at the upper surface 23 also decreases. At a certain instant, the absolute value of the force acting on the valve 22 from underneath, from the side of the lower surface 24, will exceed the force applied to the valve 22 from above and the valve will start rising.

As soon as the upper surface 23 of the valve 22 comes in contact with the upper surface of the distributing space 19, the channels 25 will be isolated from the distributing space 19 and the admission of compressed air into the chamber 5 will cease. The air will start flowing into the chamber 6 through the uncovered channels 26, through the channel 29 and the gap between the lower surface 24 of the valve 22 and the lower surface 21 of the distributing space 19.

Continuing its downward movement, the ram 2 imparts a blow to the surface being compacted through the working element 4 (FIG. 1) and starts moving up being acted upon by the force of compressed air from the side of the chamber 6.

After the outlet holes 10 in the chamber 5 (FIGS. 2,3) have been covered, the air contained in said chamber starts to be compressed and after these holes are uncovered, the air will begin to be discharged from the chamber 6. Consequently, pressure will rise in the chamber 5 and drop in the chamber 6. As a result, pressure applied to the upper surface 23 of the valve 22 through the channels 25 will rise while the pressure applied to the lower surface 24 of the valve 22 will drop. At a certain moment of time the force acting on the valve 22 from above will exceed, in absolute value, the force acting on it from below and the valve 22 will start moving down.

At a certain instant, the ram 2 will be retarded and will start moving down. Then the process will be repeated over again.

It can be seen from the description of the machine that strict accuracy of the valve travel is not required since the device controlling the air flow rate is transferred to another point of the machine. A reduction of the travel of the valve 22 caused by accumulation of carbon deposits on its surfaces 23 and 24 and on the surfaces 20 and 21 of the distributing space 19 has practically no effect on the parameters of the machine which improves the reliability of the operation.

It should be borne in mind that the embodiment of the invention shown in the drawings and disclosed in the description above constitutes only a preferred version of its realization. It should be understood that variations of shape, size and arrangement of the individual elements may occur to those skilled in the art. For example, the parts shown in the drawings and described above may be replaced by equivalent parts; position of individual parts may be changed; individual elements of the invention may be used independently of one another without departing from the spirit or the scope of the invention as herein defined in the following claims.

According to the present invention a life-size model of the hand operated pneumatic impact machine has been built of metal. As compared with the prior-art devices, the air-distributing device of the machine is about 10% cheaper in manufacture and characterized by about 15% less failures in operation.

We claim:

1. A pneumatic impact machine comprised by:

a hollow body forming a cylinder having an exhaust outlet hole located intermediate the axial ends thereof; a double acting piston reciprocable within the cylinder, the piston having opposed working faces and having an annular interior distributing space, said distributing space communicating with the respective axial ends of the cylinder through channels extending from the respective working faces of the piston to said annular interior distributing space thereof; one piston rod extending from one said working face of said piston and another piston rod extending from the other of said working faces of the piston through sealing means at the respective ends of the cylinder, one of the said piston rods extending through said annular interior space and providing a conduit for the supply of compressed air to said annular interior distributing space, said conduit communicating with said annular interior distributing space through holes formed in said one piston rod at a position substantially intermediate the axial ends of said annular interior distributing space; and a change-over valve freely slidable within the annular interior space of the piston between a first position in which one axial end thereof seals and closes the channels through one of said working faces, and a second position in which an opposite axial end thereof seals and closes the channels through the other of said working faces; said valve member being comprised of a hollow cylinder having an axial bore which is of a diameter greater than that of said one piston rod to define a clearance forming an inner channel for the passage of compressed air axially within the bore of said valve, said channels in each of the respective working faces of said piston having a combined cross-sectional area in excess of the cross-sectional area of said clearance between the valve bore and said one piston rod.

2. The pneumatic impact machine according to claim 1, wherein an inner axially extending wall of said interior distributing space is defined by an axial external surface of said one piston rod.

3. The machine according to claim 1 or 2, wherein said other piston rod has one end with an outer threaded axial surface and a threaded closed-end bore, said channels through the other of said working faces extending through an annular portion of said other piston rod and spaced from said outer threaded axial surface and said threaded closed-end bore, said piston includes a liner having an axial bore forming said distributing space and an end which is threadedly received on said outer threaded axial surface of said other piston rod, said change-over valve being freely slidable within said liner, said one rod extending through said axial bore in said liner and having a threaded end threadedly received within said closed-end bore, and said holes communicating with said distributing space.

* * * * *

UNITED STATES PATENT AND TRADEMARK OFFICE

CERTIFICATE OF CORRECTION

PATENT NO. : 4,303,002

DATED : December 1, 1981

INVENTOR(S) : Petr Avramovich Maslakov et al.

It is certified that error appears in the above—identified patent and that said Letters Patent is hereby corrected as shown below:

Column 8, line 19, (Claim 3) "axial bore" should read

-- distributing space --.

Signed and Sealed this

*Sixth* Day of *July 1982*

[SEAL]

*Attest:*

GERALD J. MOSSINGHOFF

*Attesting Officer*

*Commissioner of Patents and Trademarks*